US006114647A

United States Patent [19]

Morita et al.

[11] Patent Number: 6,114,647

[45] Date of Patent: Sep. 5, 2000

[54] BELLOWS AND VACUUM SWITCH USING THE BELLOWS

[75] Inventors: Ayumu Morita; Toru Tanimizu, both of Hitachi; Toshio Horikoshi, Fujioka; Yoshiharu Yotsumoto, Tokyo; Takanori Hashimoto, Tsubata-machi, all of Japan

[73] Assignees: Hitachi, Ltd., Tokyo; Kuze Bellows Kogyosho Co., Ltd., Ishikawa, both of Japan

[21] Appl. No.: 09/161,976

[22] Filed: Sep. 29, 1998

[30] Foreign Application Priority Data

Sep. 30, 1997 [JP] Japan ..... 9-265381

[51] Int. Cl.[7] ..... H01H 33/66

[52] U.S. Cl. ..... 218/135; 218/118

[58] Field of Search ..... 218/118, 120, 218/121, 122, 123, 124, 134, 135, 139, 140, 141, 146, 154, 155; 200/83 B, 83 C, 83 D

[56] References Cited

U.S. PATENT DOCUMENTS 2,677,393 3/1954 Cornelius ..... 200/83 B
4,585,913 4/1986 Yorita ..... 200/83 B

FOREIGN PATENT DOCUMENTS 55-143727 11/1980 Japan .

*Primary Examiner*—Lincoln Donovan
*Attorney, Agent, or Firm*—Beall Law Offices

[57] ABSTRACT

A bellows, of which one end portion is fixed to a movable lever passing through a vessel wall and the other end portion of which is fixed to the vessel wall, has a spring constant at a central portion in an expansion direction which is smaller than that at the end portions in the expansion direction. The bellows damps stress concentration at the end portions and improves the life thereof, without enlarging the size of the bellows. The bellows may be used in a vacuum switch.

6 Claims, 4 Drawing Sheets

BELLOWS AND VACUUM SWITCH USING THE BELLOWS

BACKGROUND OF THE INVENTION

1. Technical Field of the Invention

The present invention relates to a bellows and a vacuum switch and, more particularly, to a bellows used for sealing a lever portion provided so as to pass through a wall of an apparatus or device.

2. Description of Prior Art

In general, as one means for transmitting driving force without losing air-tightness between two different spaces such as between vacuum and atmosphere, bellows are used in many cases. For example, in a vacuum switch, an operating mechanism extending out of the vacuum switch and a lever passing through the vessel, move a movable rod against a fixed rod in an up and down direction to contact or separate electrodes provided on the respective rods. In this case, a bellows is used around the movable rode for sealing between the outside and the inside of the vacuum switch.

Further, as a prior art concerning this technique, JP A 55-143727 is cited, for example.

In such a mechanism, in a case where a bellows is expanded and shrunken only in an axial direction thereof as shown in FIG. 1 of JP A 55-143727, any problem does not occur. However, in a case where the lever swings around a fulcrum of a main shaft to contact and separate a movable electrode and a fixed electrode as in the vacuum switch disclosed in other figures of the above-mentioned JP A 5-143727, that is, in a case where expansion and shrinkage of the bellows deform the bellows in a curved shape, the bellows is repeatedly deformed in the curved shape, so that stresses are concentrated in the vicinity of connecting portions of the bellows, that is, in the vicinity of the fixed portion at the lever side and a fixed portion at the vessel wall side, and there may occur a crack at those portions during operation for many years and the sealing between the both spaces may be destroyed.

In this case, it is a matter of course that the stress concentration will be damped by making the diameter of the bellows larger to some extent. To make the size of the bellows larger, however, is to make larger the apparatus or device using the bellows, which is disadvantageous.

SUMMARY OF THE INVENTION

The present invention is made in view of the above-mentioned matters, and an object of the invention is to provide a kind of bellows in which stress concentration at both end portions thereof can be damped without enlarging the size and the life of the bellow can be improved, and a vacuum switch using the bellows.

That is, according to the present invention, in a bellows one end of which is fixed to a movable lever passing through a vessel wall and being swingable and the other end is fixed to the vessel wall, the above-mentioned object is achieved by the bellows being formed so that the spring constant of the bellows at its central portion in the expansion direction is smaller than that at the one end portion or the end portions in the expansion direction.

Further, according to the present invention, in a bellows, one end of which is fixed to a movable lever passing through a vessel wall and being swingable and the other end is fixed to the vessel wall, the bellows is formed so that the pleat height of the bellows at a central portion in the expansion direction is larger than that at the end portions in the expansion direction.

Further, in this case, the bellows is formed so that the pleat height increases continuously from the both end portions to the central portion. Further, the bellows is formed so that the outside of the bellows is shaped in the form of a beer barrel.

Further, in a vacuum switch comprising fixed and movable electrodes arranged in a vacuum vessel so as to oppose each other, a movable conductor connected to the movable electrode, passing through the vessel and mounted swingably and moving the movable electrode, and a bellows of which one end is fixed to the movable conductor and the other end of which is fixed to a wall of the vessel, any one of the above-mentioned bellows is used for this bellows.

That is, in the bellows formed in this manner, since the spring constant at a central portion in the expansion direction of the bellows is made smaller than that at end portions in the expansion direction, the central portion of the bellows has a more flexible construction than the end portions. Therefore, even if the bellows is deformed in a curved shape, stresses at the end portions are dispersed toward the central portion. Therefore, stress concentration at the end portions is damped without enlarging the size of the bellows and it is possible to improve the life.

Further, when the spring constant of the bellows at the central portion is made small, the pleat height of the bellows is changed, that is, the pleat height of the bellows at the end portions becomes smaller than that at the central portion, so that it is also possible to prevent the pleats near each end portion from contacting each other.

DESCRIPTION OF EMBODIMENTS OF THE INVENTION

Figure 1:
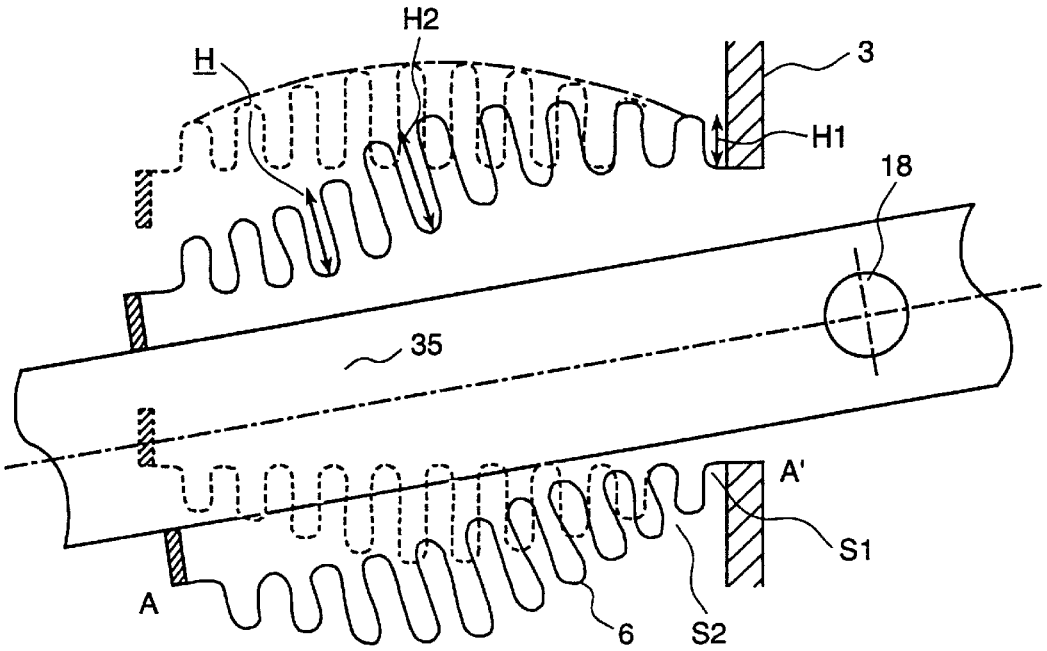
FIG. 1 is a vertical sectional view of a bellows of an embodiment of the present invention.

The present invention is explained hereunder in detail, based on embodiments illustrated in the figures of the drawings. In FIG. 1, sections of a bellows and peripheral constructions of the bellows are shown. A symbol 3 denotes a vessel side wall of an apparatus or device such as a vacuum switch, etc., and it is formed so that both sides of the side wall are different spaces. A symbol 35 denotes a movable lever which is provided so as to pass through the apparatus or device vessel wall and operates a device inside the vessel of the apparatus.

The movable lever 35 is provided so as to pass through the vessel wall 3 and formed so as to swing around a fulcrum of a main shaft 18 provided outside the vessel. For a movable lever passing portion of the apparatus or device vessel, a bellows 6 is provided which is mounted on both the vessel wall 3 and the movable lever 35. That is, the bellows is fixed to the movable lever at its one end and to the vessel wall 3 at its other end. The bellows has a plurality of outwardly extending, circumferential pleats between the ends of the bellows, with each of the pleats extending around the entire circumference of the bellows.

In this case, particularly, the bellows 6 is formed as follows. That is, the pleat height H of the bellows at a central portion in the expansion direction is made larger than that at end portions in the expansion direction. In other words, the spring constant of the bellows at the central portion in the expansion direction is formed smaller than that at the end portions in the expansion direction.

In such a bellows, since the central portion of the bellows is more flexible in construction than the end portions, even if a curved deformation due to a movement such as an axis deviation movement occurs in the bellows, stresses at the end portions of the bellows are dispersed toward the central portion. Therefore, the stress concentration at both end portions of the bellows is damped.

Figure 2:
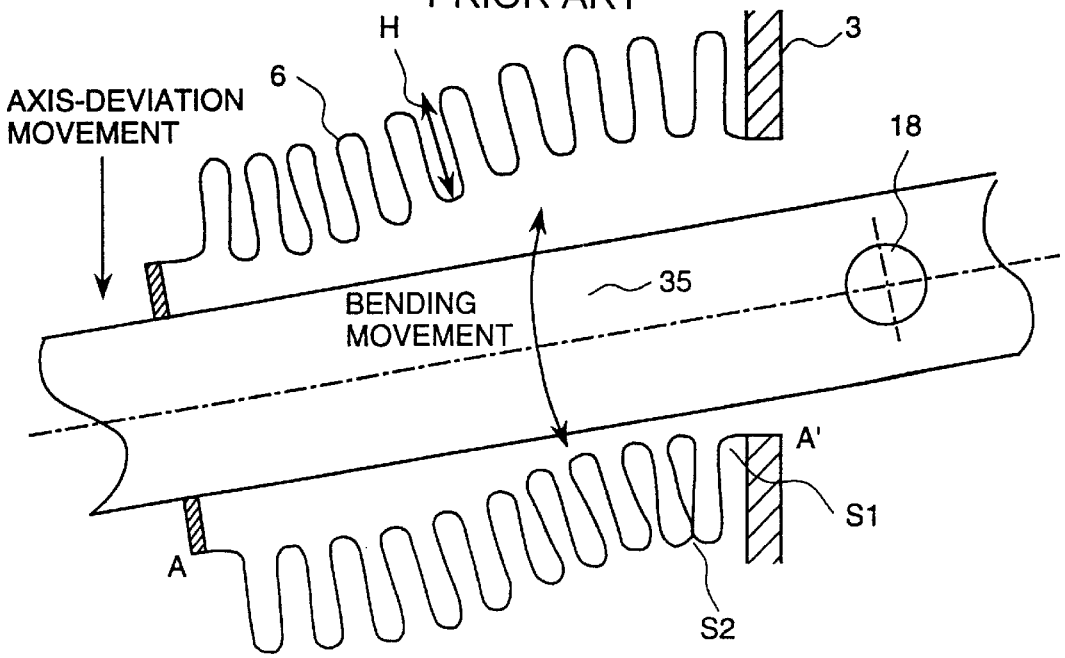
FIG.2 PRIOR ART
FIG. 2 is a vertical sectional view of a conventional bellows.
Figure 3:
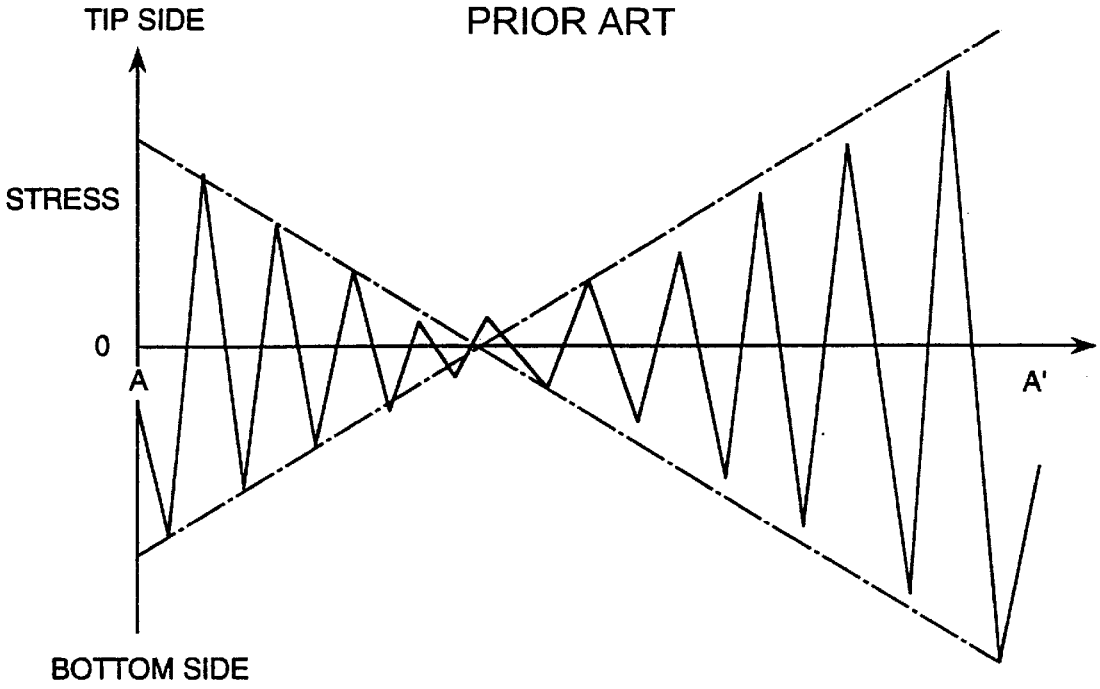
FIG.3 PRIOR ART
FIG. 3 is a characteristic diagram showing stresses acting on the conventional bellows.

That is, in comparison to a conventional bellows, in a case where the main shaft 18 exists outside the bellows 6 as shown in FIG. 2, the bellows 6 effects complex movements of "bending movement" and "axis deviation movement". In this case, a distribution of stresses occurring in the bellows 6 is as shown in FIG. 3. In this figure, an abscissa of the graph indicates positions between both ends A-A' of the bellows and the ordinate indicates stresses of the bellows 6 at the tip and bottom.

Figure 4:
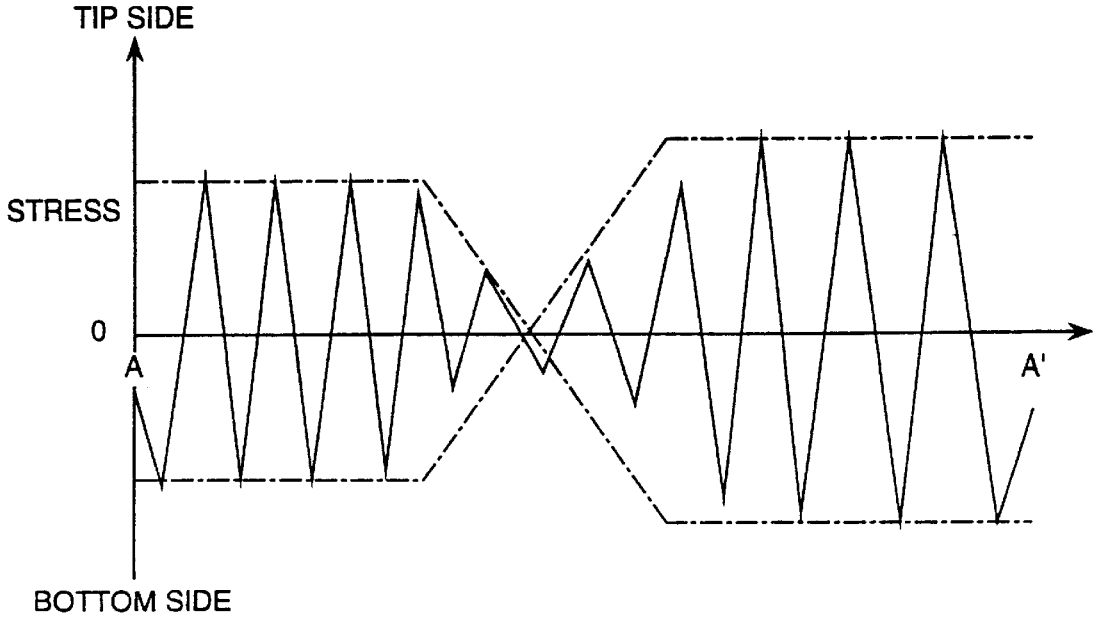
FIG. 4 is a characteristic diagram showing stresses acting on the bellows of the embodiment of the invention.

That is, it is noted from the figure that stress concentration occurs at the end portion S1 of the bellows 6. Further, according to a condition of a rotational angle, etc., there is a portion S2 as shown in FIG. 2 at which the pleat tips of the bellows 6 are contacted with each other, and the stress concentration may be promoted further. On the contrary, in the bellows 6 of the present invention, the pleat height H (refer to FIG. 1) increases continuously from the end portions to the central portion of the bellows 6 and equivalently the spring constant at the central portion becomes smaller than that at the end portions, the stress concentration is such that stresses of the bellows 6 at the end portions are dispersed toward the central portion, as shown in FIG. 4. Further, since the pleat height H1 at the end portions is made smaller than that of H2 at the central portion, it is possible to sufficiently prevent the pleat tips at the portion S2 from contacting with each other.

Further, in this case, by forming the bellows so that the pleat height of the bellows changes continuously from the end portions toward the central portion, it is possible to disperse the stresses uniformly in the expansion direction and it is possible to make the life of bellows long.

Figure 5:
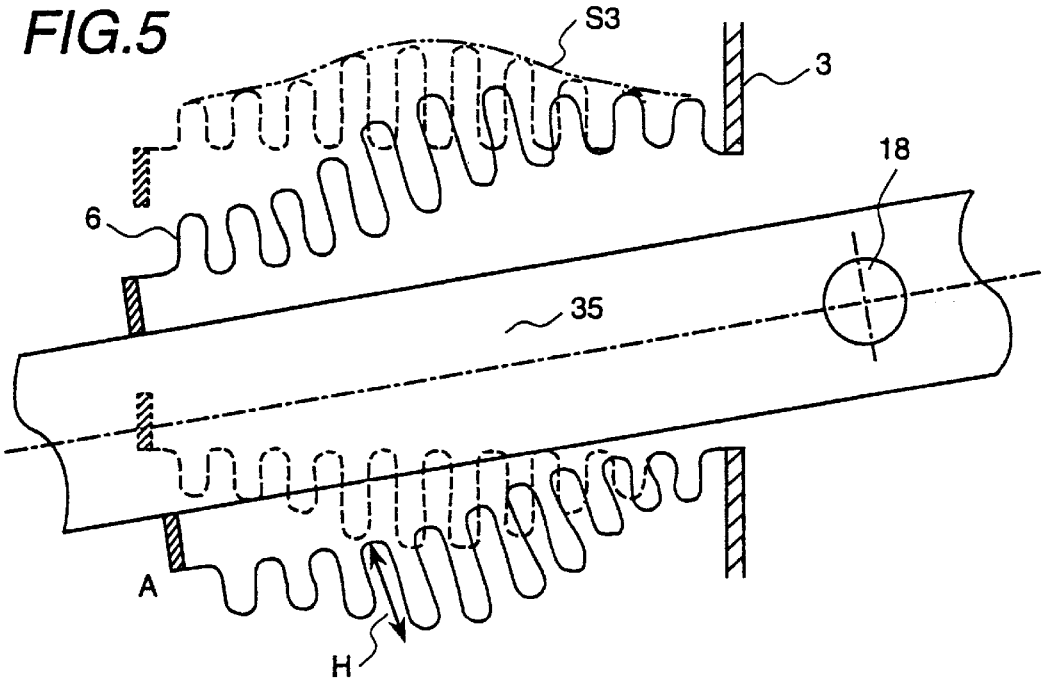
FIG. 5 is a sectional view for explaining an operation of a bellows of another embodiment of the invention.

Further, in the above explanation, in the case where the spring constant of the bellows at the central portion is made smaller than that at the end portions, the bellows is formed so that the pleat height changes in the expansion direction, however, other means or method such as changing pleat pitches, changing thickness of the bellows, etc. will be considered for changing the spring constant. Further, although the outside of the bellows is formed in a beer barrel shaped type construction in this case, it is not always necessary to take such a construction, that is, a convex construction of such a shape that the central portion is extremely expanded as shown in FIG. 5, for example, can be taken.

As it has been explained above, in the bellows according to the present invention, since the spring constant of the bellows at the central portion is made smaller than that at the end portions, even in a case where the main shaft 18 is disposed outside the bellows 6, stresses occurring at the end portions of the bellows 6 can be dispersed toward the central portion, and the bellows 6 can be made small in size as compared with a conventional bellows and improved in life.

Figure 6:
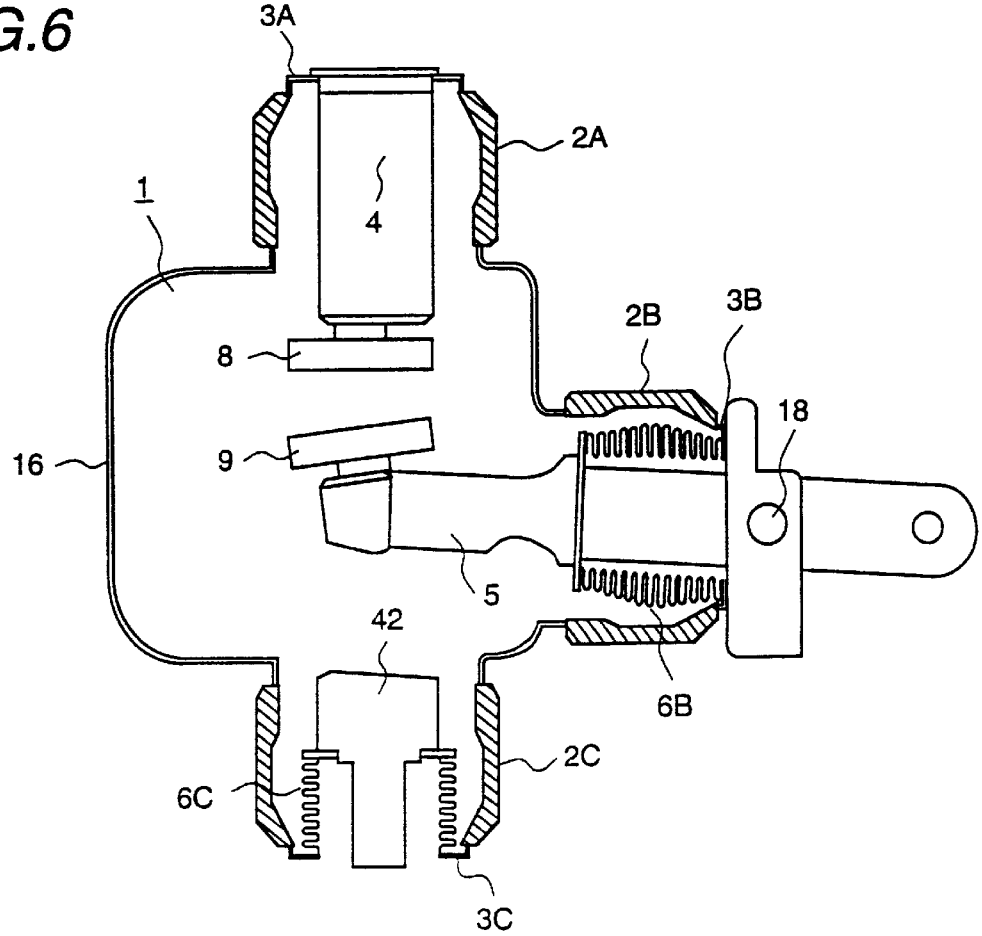
FIG. 6 is a vertical sectional view of a vacuum switch employing the bellows of the present invention.

Another embodiment described next is an embodiment in which the bellows according to the present invention is applied in a vacuum switch, and will be explained, referring to FIGS. 6 to 8. The vacuum switch 1 is constructed hereunder and the interior is sealed in vacuum. On the upper portion of a metal case 16, an insulating cylinder 2A is provided and a fixed rod 4 is disposed in the vacuum switch 1 and held by a seal metal 3A provided on the upper portion of the insulating cylinder 2A. Further, on the lower portion of the metal case 16, an insulating cylinder 2C is provided and in the inside thereof a grounded conductor 42 is held through a bellows 6C and a seal metal 3C.

Further, a movable rod 5 (movable lever), arranged so as to extend in a direction perpendicular to the above-mentioned fixed rod 4, extends outside, passing through a wall portion of the vacuum switch 1 and an insulating cylinder 2B joined as a part of the wall. The movable rod 5 is rotatably or swingably held by a main shaft 18, a bellows 6B and a seal metal 3B. At the tips of the fixed rod 4 and the movable rod 5, a fixed electrode 8 and a movable electrode 9 are provided, respectively, each of which is made of a Cu-Pb alloy, for example. The electrodes 8, 9 are closed and opened by rotating or swinging the movable rod 5 around a fulcrum of the main shaft 18 provided outside the bellows 6B.

The bellows 6B fixed and sealed to the movable rod 5 is formed so that the pleat height H increases from the end portions toward the central portion and the outside is shaped in a barrel type shape, as the previously mentioned embodiment. Here, effects of the present embodiment will be explained.

The movable rod 5 rotates around the fulcrum of the main shaft 18 provided outside the bellows 6B. Therefore, the bellows 6B effects complex movements of "bending movement" and "axis deviation movement. Since the spring constant of the bellows 6B at the central portion is made smaller than that at both end portions, it is possible to reduce stress concentration at the root portion S1 of the bellows 6B, the bellows 6B can be small-sized, and the life is improved.

Figure 7:
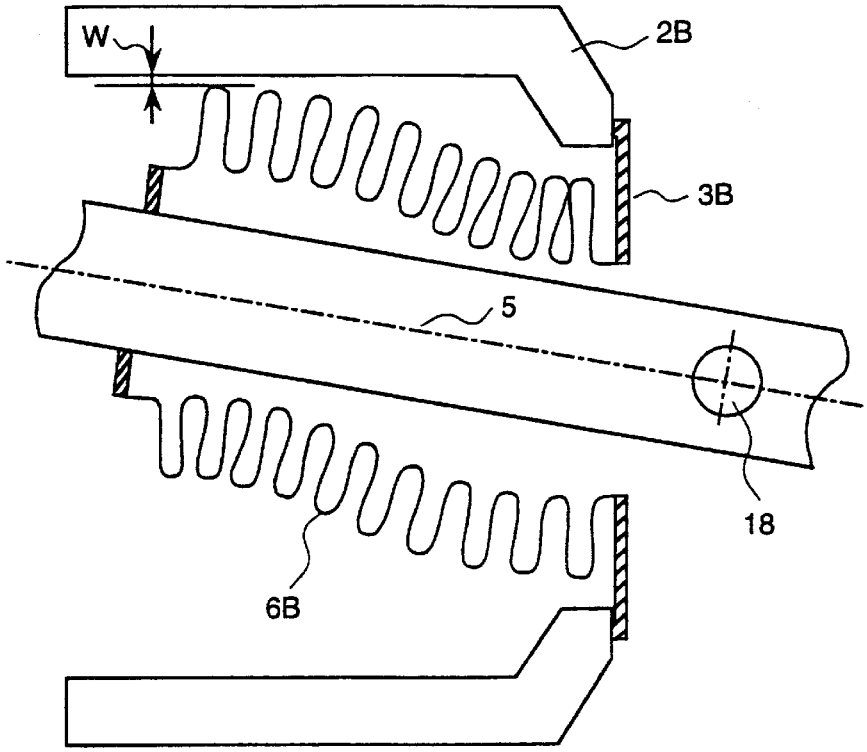
FIG.7 PRIOR ART
FIG. 7 is a sectional view showing a positional relationship between an insulating cylinder and a bellows of a vacuum switch in the case where a conventional bellows is used.
Figure 8:
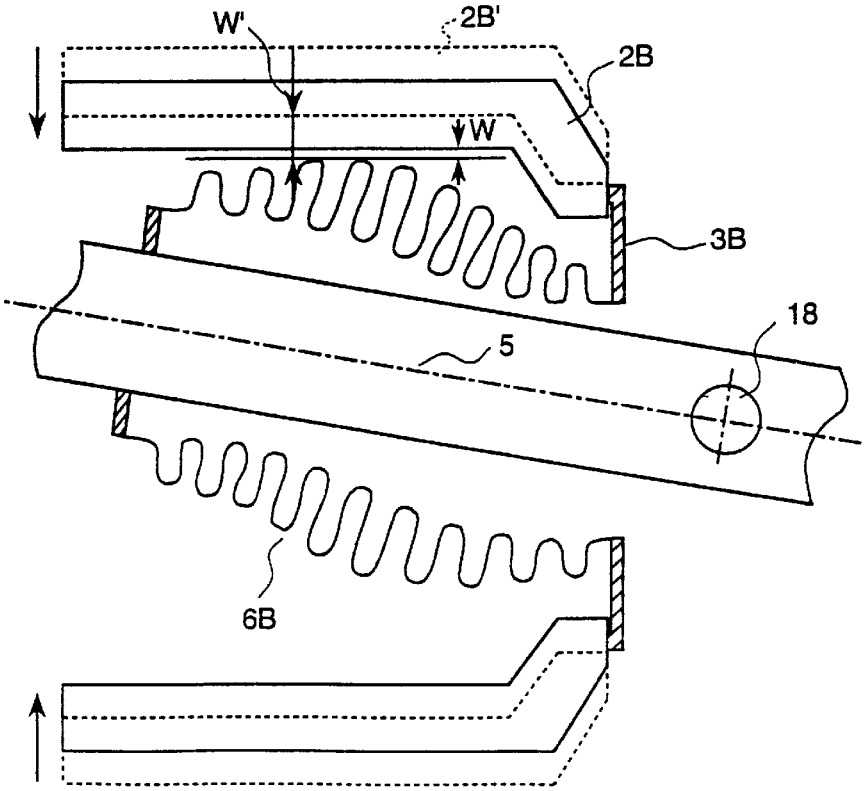
FIG. 8 is a sectional view showing a positional relationship between an insulating cylinder and a bellows of a vacuum switch in the case where a bellows according to the invention is used.

Further, FIGS. 7 and 8 show a relationship between a bellows 6B, 6B' and an insulating cylinder 2B, 2B' when the movable rod 5 is rotatably displaced. In FIG. 7 showing a conventional structure in which a conventional bellows 6B' is used, a necessary gap W is secured between the bellows 6B' and the insulating cylinder 2B'. In FIG. 8, also a necessary gap W is secured between the bellows 6B and the insulating cylinder 2B. A chain line in FIG. 8 indicates the position of the insulating cylinder 2B' when the conventional bellows 6B' as shown in FIG. 7 is used. The size of the insulating cylinder 2B is reduced greatly by using the bellows 6B, the pleat height of which is reduced at both end portions. As shown in FIG. 8, even if the size is reduced, since the pleat height H of the bellows at both end portions is made smaller than that at the central portion, a gap between the insulating cylinder 2B and the bellows 6B can be secured even at the time of rotation of the bellows 6B, and the insulating cylinder 2B can be made small in size. As a result, the switching device can be made small in size as a whole.

As shown in FIG. 3, the stress at the end fixed to the vessel wall is larger than that at the end fixed to the movable rod. It is also effective that the pleat height is decreased from the end portion at the lever side to that at the vessel wall side.

Further, the above explanation is concerned with the case where the bellows is applied to a vacuum apparatus, however, it is a matter of course that it can be applied to a gas vessel, a liquid vessel, etc..

As explained above, according to the present invention, a bellows, in which stress concentration at both end portions of the bellows is damped without enlarging the size of the bellows and the life of the bellows can be improved, and a vacuum switch employing the bellows can be obtained.

What is claimed is:

1. A bellows, one end of which is fixed to a movable lever passing through a vessel wall and being swingable and the other end of which is fixed to the vessel wall, characterized in that said bellows is formed so that a spring constant of said bellows at a central portion thereof in an expansion direction is smaller than a spring constant at at least one end portion thereof in the expansion direction.

2. A bellows, one end of which is fixed to a movable lever passing through a vessel wall and being swingable and the other end of which is fixed to the vessel wall, characterized in that said bellow has a plurality of outwardly extending pleats between the ends of said bellows, each of said pleats extending around a circumference of said bellows and wherein the pleat height of said bellows at a central portion in an expansion direction is larger than that at end portions thereof in the expansion direction.

3. A bellows according to claim 2, wherein said bellows is formed so that the pleat height changes continuously from both end portions to the central portion.

4. A bellows according to 1, 2 or 3, wherein said bellows is formed so that the outside of said bellows is shaped in the form of a beer barrel.

5. A vacuum switch comprising fixed and movable electrodes arranged in a vacuum switch vessel so as to oppose each other, a movable conductor, connected to said movable electrode, passing through said vessel and swingably mounted for moving said movable electrode, and a bellows, of which one end is fixed to said movable conductor and the other end of which is fixed to a wall of said vessel, wherein the bellows according to claim 1, 2 or 3 is used for said bellows of said vacuum switch.

6. A bellows according to claim 1, wherein said bellows has a plurality of outwardly extending pleats between the ends of said bellows, each of said pleats extending around a circumference of said bellows and said spring constant changes continuously from said at least one end portion to said central portion.

* * * * *